United States Patent [19]

Gilbert

[11] 4,071,224

[45] Jan. 31, 1978

[54] TRAFFIC SAFETY CONTROL MODULE SYSTEM

[76] Inventor: Herbert Allan Gilbert, 278 McKinley Road, Beaver Falls, Pa. 15010

[21] Appl. No.: 697,767

[22] Filed: June 21, 1976

[51] Int. Cl.[2] ..... E01F 13/00

[52] U.S. Cl. ..... 256/64; 256/1; 116/63 P; 182/181; 40/612

[58] Field of Search ..... 256/64, 1, 13.1; 116/63 P; 40/125 H, 125 N; 182/181, 224; 404/6-9

[56] References Cited

U.S. PATENT DOCUMENTS

| | | | |
|---|---|---|---|
| 3,456,100 | 7/1969 | Green | 116/63 P X |
| 3,800,735 | 4/1974 | Simpson | 40/125 H X |
| 3,837,626 | 9/1974 | Dixon | 256/64 |
| 3,877,681 | 4/1975 | Humphrey | 256/64 |
| 3,880,406 | 4/1975 | Stehle et al. | 116/63 P X |
| 3,950,873 | 4/1976 | Stehle et al. | 256/64 X |

*Primary Examiner*—Andrew V. Kundrat
*Attorney, Agent, or Firm*—Howard E. Sandler

[57] ABSTRACT

A traffic safety control module system and more particularly a module system comprising two primary module configurations which may be selectively utilized to construct: barricades and channeling devices; vertical panels; systems which are acceptable and superior substitutes for barrel or drum applications; guard rail sections; impact barrier systems; and the like.

16 Claims, 20 Drawing Figures

TYPE I BARRICADE (PRIOR ART)
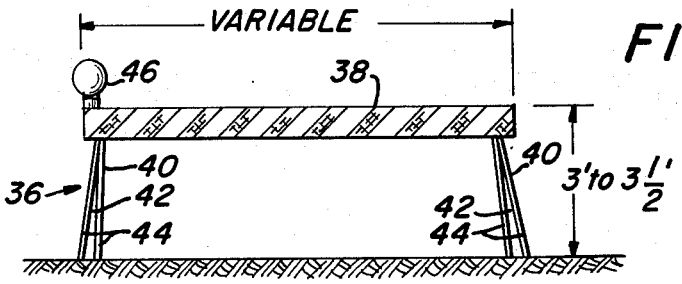
FIG. 1
FIG. 2
TYPE II BARRICADE (PRIOR ART)
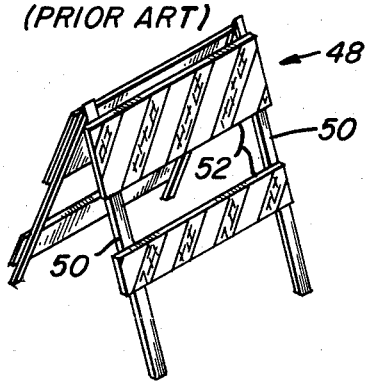
FIG. 3
TYPE III BARRICADE (PRIOR ART)
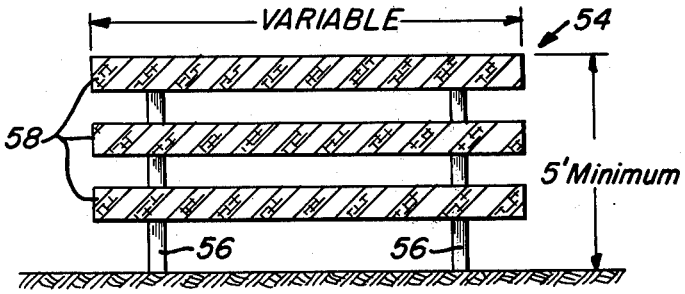
FIG. 4
(PRIOR ART)
VERTICAL PANEL
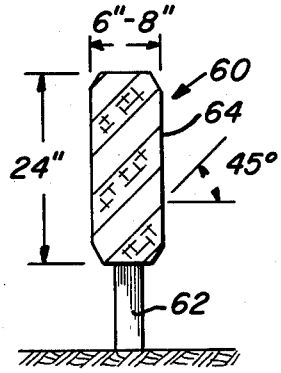
FIG. 5
(PRIOR ART)
BARREL BARRIER
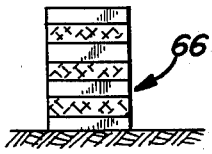

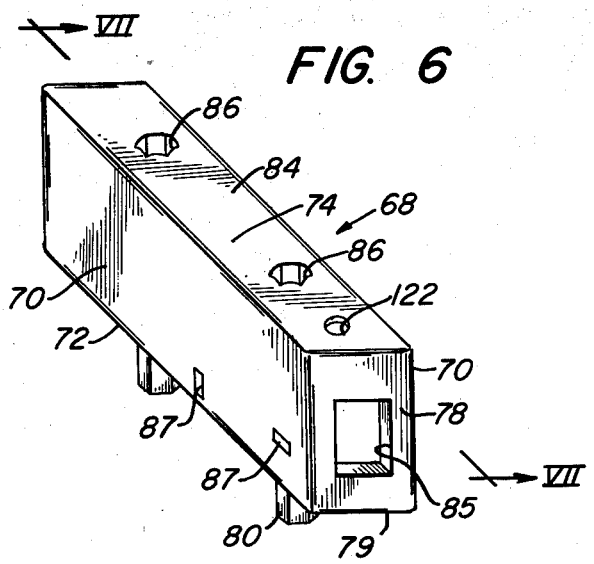
FIG. 6
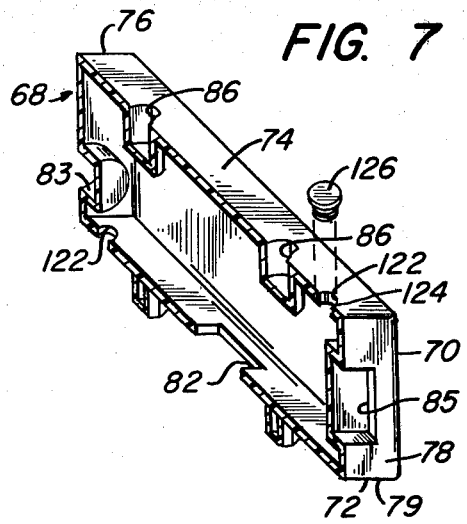
FIG. 7
FIG. 8
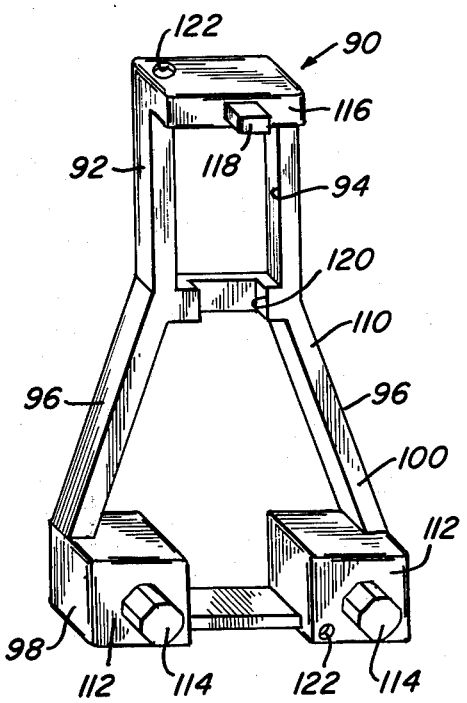
FIG. 9
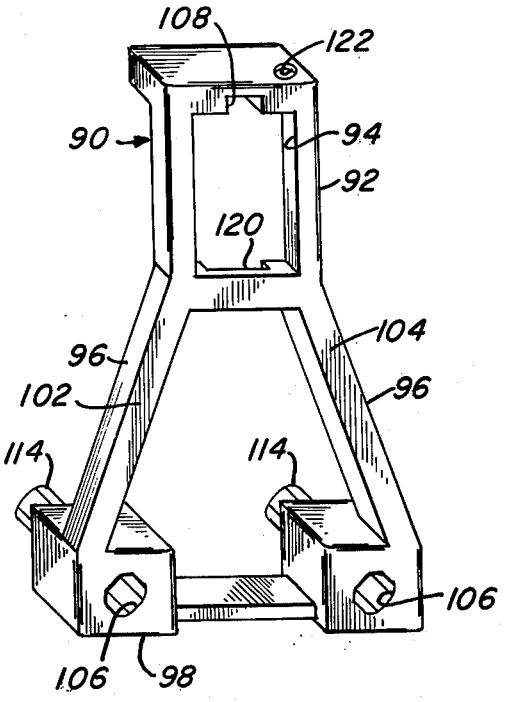

TRAFFIC SAFETY CONTROL MODULE SYSTEM

Barricade and channeling devices, vertical panel systems, barrel or drum applications, guard rail sections, impact barrier system and the like are all necessary systems of types which have specific applications for temporarily directing and protecting traffic, both vehicular and pedestrian. Such temporary traffic safety control systems are commonly used at road construction and repair sites, to close off unused traffic lanes, to obstruct ends of lanes, to delineate parade routes, to guard excavating and building sites, control crowds in all types of major events, to designate rough or damaged roadways and sidewalks, and to generally warn against hazards.

To achieve the above-mentioned purposes a variety of independently constructed safety control systems have been used depending on the requisite controls required. In order to be prepared to best handle any type of situation regardless of the circumstances involved responsible parties such as contractors, state and local highway departments and various law enforcement agencies have been required to utilize and preferably stock a large variety of safety control apparatus which have a single specified usage and are generally not interchangeable. Examples of specific generally non-interchangeable single usage traffic control systems can be seen in the 1971 Edition of the "Manual on Uniform Traffic Control Devices for Streets and Highways" which is published by the U.S. Department of Transportation, Federal Highway Administration and has been adopted by the Federal Highway Administration as a National Standard for application on all classes of highways. Several of the safety devices illustrated in such manual include: a Type I Barricade which is generally of a saw horse configuration having a specified height of 3 to 3-½ and a variable length; a Type II Barricade of a generally "A-Frame Configuration" and being generally 3 to 3-178 high and of a generally fixed standard length; a Type III Barricade having a minimum height of 5, a variable length and a plurality of longitudinally extending rails; a Vertical Panel which is generally used as a channelizing device and includes a variable length longitudinally extending panel of a height of 24 inches; and cylindrical drums.

By means of the present invention which incorporates a modular approach to a safety control system each of the abovementioned system configurations as well as many other configurations can be readily constructed from a combination of only two basic module components thereby enabling any contractor, authority or department to easily maintain a module stockpile which can be utilized to custom design a temporary traffic control system which is most suitable for the particular situation involved.

Still another object and advantage of the instant invention resides in the fact that the module components have cooperating configurations to interlock adjacent components. The configuration is such that components of one type interlock with each other as well as with components of the other type. Such an attribute in a system of this type allows a single individual to easily assemble and disassemble variations configuration systems without the requirement of any sort of tools.

A still further object and advantage of the present invention resides in the fact that the basic modules are hollow and are formed of a deformable substance, for example rotationally molded of a suitable resinlike material such as a polyethylene. A hollow configuration permits a ballast to be poured into the modules thereby improving the transverse stability of a system utilizing the modules. Furthermore, by utilizing a hollow module configuration of a deformable material, potential damage to the modules or vehicles is minimized in the event that the modules are struck by moving vehicles. Still further, modules formed of a polyethelene are lightweight and easy to handle and their usage does not result in rust or mold problems.

An additional object and advantage of the present invention resides in greater stability than prior art temporary traffic control systems because of a polygonal configuration that has a relatively greater contact surface area, a greater resistance to bending because of increased section modulus and a superior reception surface area for sandbagging.

A still further object and advantage of the present invention resides in the ease and superiority of signing.

These and other objects and advantages of the present invention will become more readily apparent from a reading of the following description and drawings, in which:

FIG. 1 is a longitudinal elevational view of a prior art Type I Barricade;

FIG. 2 is a prospective view of a prior art Type II Barricade;

FIG. 3 is a prospective view of a prior art Type III Barricade;

FIG. 4 is a side elevational view of a prior art Type Vertical Panel;

FIG. 5 is a side elevational view of a prior art Drum barricade;

FIG. 6 is a prospective view of a rail module constructed in accordance with the principles of the present invention;

FIG. 7 is a cross-sectional view of a rail module taken on lines 7—7 of FIG. 6;

FIG. 8 is a prospective view of a support module constructed in accordance with the principles of the present invention;

FIG. 9 is another prospective view of the support module of FIG. 8 viewed on a different angle;

Figure 10:
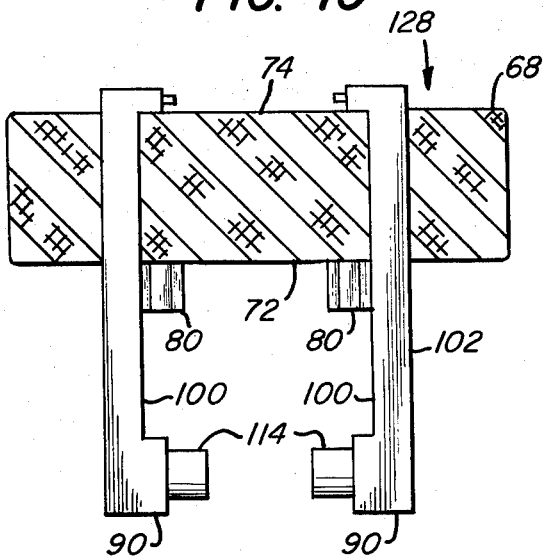
FIG. 10 is a longitudinal elevational view of a Type I Barricade constructed in accordance with the principles of the present invention.

FIGS. 1 through 5 illustrate prior art type temporary traffic control systems as can be seen in the 1971 Edition of the "Manual on Uniform Traffic Control Devices for Streets and Highways" which is published by the United States Department of Transportation, Federal Highway Administration and as adopted by the Federal Highway Administration as a National Standard for application on all classes of highways.

FIG. 1 illustrates a prior art Type I barricade 36 which comprises a single variable length rail 38 supported adjacent each axial end thereof by "A-Frame" support members 40. In general the rail 38 of prior art Type I barricades is constructed of wood or thin sheet metal and the support members 40 thereof are formed of light weight metal construction. If necessary to more positively position the barricade 36 in windy conditions, it is customary to drape a sandbag (not shown) over the cross members 42 which extend between the diagonals 44 of support members 40. The particular prior art Type I barricade illustrated in FIG. 1 includes diagonal warning striping along rail 38 and a flasher 46 releasably affixed to rail 38 adjacent one axial end thereof. Type I barricades are generally 3 to 3½ feet in height and are of a variable length.

FIG. 2 illustrates a prior art Type II barricade 48 comprising: diagonal inverted "V" shaped support members 50 adjacent each end of barricade 48; and upper and lower rails 52 extending intermediate support members 48 on each side thereof. In general prior art Type II barricades were of a light guage metal construction. Type II barricades are generally 3 to 3½ feet in height and are of a fixed length of approximately 3 feet and prior art configurations were rather difficult to sand bag.

FIG. 3 illustrates a prior art Type III barricade 54 comprising vertical post supports 56 and a plurality of vertically spaced rails 58 extending between support members 56. In the embodiment illustrated upper, lower and middle rails 58 are included. Type III barricades are of variable length with a five foot minimum height.

FIG. 4 illustrates a prior art Vertical Panel 60 which comprises a lower vertical post 62 and an upper channel portion 64. Vertical Panels are used as channelizing devices and the channel portion 64 is generally 6 to 8 inches in width and at least 24 inches in height with the top of portion 64 being at least 36 inches above the roadway.

FIG. 5 illustrates a prior art drum type barricade 66. Barricade 66 is additionally used as a channelizing device and is generally partially filled with concrete or sand and flashers or signing may be incorporated with drum 66 to direct traffic or warn of imminent dangers.

The traffic control systems illustrated in FIGS. 1–5 are well known in the prior art and further description thereof will be dispensed with except where necessary to more fully describe the present invention. The primary reason for illustrating the systems of FIG. 1–5 is to more clearly illustrate the significance of the present invention whereby with two primary module configurations, equivalent traffic control systems may be constructed to each of the prior art systems of FIG. 1–5 as well as a plurality of other traffic control systems.

FIGS. 6 and 7 illustrate a rail module 68 constructed in accordance with the principles of the present invention. As shown rail module 68 is of a generally rectangular configuration and comprises: transversely spaced generally planar vertical walls 70; longitudinally extending sidewalls 72 and 74; and transversely extending endwalls 76 and 78. Walls 70, 72, 74, 76 and 78 all have a generally rectangular peripheral configuration and are integrally formed, for example of polyethylene and by a rotational molding process, to form a hollow generally rectangular hollow tubular module 68. In the instant embodiment module 68 includes dimensions of 36 inches (long sides of walls 70, 72, 74 and 76) by 12 inches (short sides of walls 70 and long sides of walls 76 and 78) 6 inches (short sides of walls 72, 74, 76 and 78).

Vertical walls 70 are generally planar and include no depressions or projections formed therein. Sidewall 72 comprises: a main planar wall portion 79; a pair of longitudinally spaced locking projections 80 integrally formed with wall portion 79 intermediate the axial ends thereof; and a flasher or signing depression 82 extending inwardly from wall portion 79 and integrally formed therewith intermediate projections 80. Suitable flasher or signing depressions 83 and 85 are additionally provided in end walls 76 and 78, respectively. Projections 80 extend outwardly from wall portion 71 and are generally polygonal in cross section. As shown, projections 80 have an octagonal cross section. Sidewall 74 comprises: a main planar wall portion 84; and a pair of longitudinally spaced locking depressions 86 integrally formed with wall portion 84 intermediate the axial ends thereof and projecting inwardly therefrom. Depressions 86 are spaced from projections 80 and generally coaxial therewith. The interior peripheray of depressions 86 corresponds to the external peripheray of projections 80.

The specific advantages of the configuration of sidewalls 72 and 74 described hereinabove will be readily apparent in the system embodiments described hereinafter; however, at this point it is to be noted that rail modules 68 can be readily stacked one on top of the other for storage or purposes of system construction. This "stacking" is accomplished by the cooperation of projections 80 being captively received within corresponding depressions 86 of adjacent modules 68. Furthermore, the stacking can be in parallel or angular relationship. The angular mode relationship is possible by the octagonal configuration of depressions 86 and projections 80 thereby enabling the locked angular positioning of a series of modules 68 as may be dictated by specific system requirements. To further facilitate stacking and positive retention of assembled systems suitable strapping openings 87 are integrally formed in modules 68. As shown, two walled strapping openings 87 are included and extend through a sidewall 70 and extend through to open in depressions 85 and 83.

FIGS. 8 and 9 illustrate a support module 90 constructed in accordance with the principles of the present invention. Support module 90 is a hollow structure suitably formed, for example of a polyethylene by a rotationally molded process and comprises a generally rectangular upper portion 92 having a walled rectangular opening 94 therethrough. The rectangular dimensions of opening 94 are approximately equal to the general transverse dimensions of rail 68 (i.e. 12 × 36). Integrally formed diagonal legs 96 extend downwardly and outwardly from the lower end of portion 92. A strut portion 98 is integrally formed with legs 96 adjacent the lower ends thereof and extends transversely therebetween. For purposes of description hereinafter the inner wall 100 of module 90 shall refer to the wall having projections extending therefrom said and the outer wall 102 shall refer to the vertical wall of module 90 parallel to and transversely spaced from wall 100.

Outer wall 102 comprises: a main planar wall portion 104; a pair of transversely spaced inwardly extending locking depressions 106 each of which are formed within wall portion 104 adjacent the intersection of strut 98 with a respective diagonal leg 96; and an inwardly extending module stacking depression 108 formed transversely intermediate wall portion 104 adjacent the upper end of wall 102. The interior periphery of locking depressions 106 are polygonal in configuration and correspond to the internal periphery of depressions 86 and the external periphery of projections 80. Furthermore, the transverse spacing between depressions 106 is exactly the same as the transverse spacing between pairs of projections 80 and pairs of depressions 86.

Inner wall 100 comprises: a main planar wall portion 110; raised wall portions 112 adjacent each intersection of strut 98 with a respective diagonal leg 96; a pair of transversely spaced locking projections 114 one of which is integrally formed with each wall portion 112; an upper raised wall portion 116 extending transversely along the upper end of wall 100; a module stacking projection 118 formed transversely intermediate wall portion 116; and a vertically extending rail locking groove 120 positioned intermediate the lower transversely extending portion of rectangular portion 92. Projections 118 are spaced from locking depressions 108 and generally coaxial therewith. The interior periphery of depressions 106 corresponds to the external periphery of projections 118. Similarly the stacking depression 106 is spaced from the stacking projection 114, is generally coaxial therewith and is of a corresponding configuration.

The specific advantages of the above-described support module 90 will become readily apparent in the description of the system embodiments described hereinafter; however, at this point it is to be noted that support modules 90 can be readily stacked for storage or for purposes of system construction. This "stacking" is accomplished by the cooperation of locking projections 114 being captively received within locking depressions 106 and stacking projections 118 being captively received within stacking depressions 108. Such an arrangement releasably locks both the upper and lower ends of adjacent pairs of stacked support modules 90.

It is to be noted that both rail module 68 and support module 90 each may include fluid fill or exhaust means 122 therein which comprise an integrally formed bore 124 and a suitable closure member such as member 126 which is threadably and sealingly received within bore 124. As shown rail module 68 includes a means 122 within sidewalls 72 and 74 and support module 90 includes a means 122 adjacent the upper and lower ends thereof. With such an arrangement of means 122, modules 68 and 90 can, if desired, be filled with a hydraulic fluid to provide added system stability. Furthermore, a traffic control barrier which utilizes hydraulic fluid filled modules 68 and 90 are better capable of absorbing and dissipating impact thereby better protecting occupants of a vehicle which crashes into a barrier. If desired a more controlled shock energy dissipation system for modules 68 and 90 may be developed by forming closure members 126 in a manner that they will provide a pressure relief in the event that pressure within modules 68 and 90 reaches a predetermined maximum. Such pressure relief may be provided by a suitable preset pressure relief valve being integrated within closure members 126 or a predetermined axial shearing relationship being established between the mating threads of member 126 and bore 124. In temperature below freezing an anti-freeze ingredient may be added to the hydraulic fluid within modules 68 and 90. It is to be noted that means 122 are included on opposite sides of modules 68 and 90 for ease of addition and draining of hydraulic fluid from the modules.

FIG. 10 is a longitudinal elevational view of a Type I Barricade 128 constructed in accordance with the principles of the present invention which comprises vertically disposed spaces support modules 90 with a rail module 68 extending therebetween. Modules 90 are oriented with the lowermost surface of strut 98 engaging the ground and inner walls 100 of the spaced modules 90 facing each other. End portions of rail module 68 are slidingly received through the walled opening 94 of adjacent support includes 90 and extend outwardly therefrom. In assembled position sidewall 72 of rail module 68 faces downwardly and the transversely outermost surface of locking projections 80 abut the innermost surface of rail locking grooves 120 of respective support modules 90. In such positioning other surfaces of projections 80 are adjacent respective surfaces of grooves 120 to provide even further stability of movement of rail module 68 with respect to support modules 90. If desired, further stability of barricade 128 can be provided by utilizing additional ballast such as filling modules 68 and 90 with a liquid and/or draping sand bags (not shown) over lower struts of support modules 90.

Figure 11:
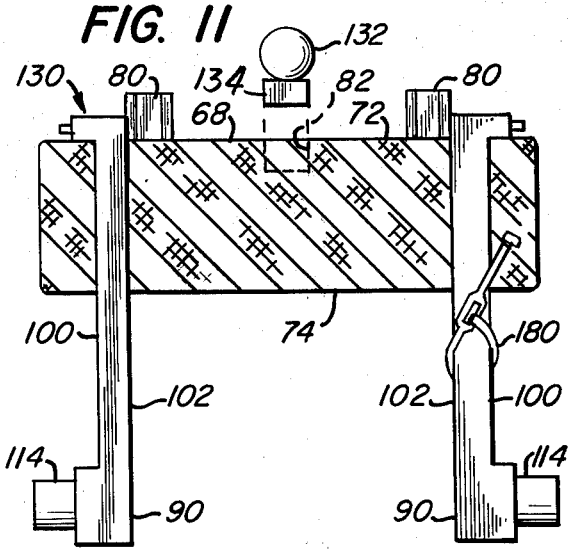
FIG. 11 is a longitudinal elevational view of another embodiment of a Type I Barricade constructed in accordance with the principles of the present invention.
Figure 20:
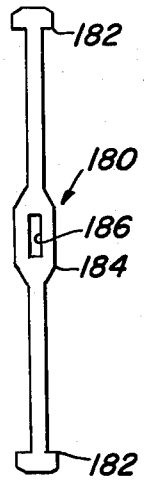
FIG. 20 is a plan view of a strap utilized in stabilizing barricade assemblies constructed in accordance with the principles of the present invention.

FIG. 11 is a longitudinal elevational view of a Type I Barricade 130 quite similar to the embodiment illustrated in FIG. 10 with the primary distinction therebetween being that outer walls 102 of the spaced support modules 90 face each other and sidewall 72 of rail module 68 faces upwardly rather than downwardly. With such an embodiment locking projections 80 abut adjacent walls 102 adjacent the upper end thereof and extend upwardly therefrom. Type I Barricade 130 has a primary advantage of Barricade 128 described hereinabove inasmuch as with the configuration of barricade 130 depression 82 in sidewall 72 is upwardly open thereby greatly facilitating the support of a suitable flasher such as flasher 132 by a Type I Barricade constructed in accordance with the principles of the present invention. As shown the lower portion 134 is of a polygonal configuration which conforms to the peripheral surface of depression 82 and is slidably received therein. It is to be noted that still further means for insuring stability and integrity of assemblies constructed in accordance with the principles of the present invention is illustrated in FIG. 11 which makes use of a strap 180. Strap 180 is illustrated in FIG. 20 and comprises an elongated body portion having transversely extending enlarged end portions 182 and an enlarged central portion 184 having an axially extending slot 186 therethrough. FIG. 11 illustrates a strap 180 in position wherein one end portion 182 is in opening 87 adjacent a flashing depression 85, the main body of strap 180 is wound about an upper portion of a diagonal leg 96 of support module 90 and the other end portion 182 is releasably received within the slot 186 of strap 180. Such an arrangement provides more positive stability of the barricade 130. At this juncture it is to be further noted that longer and shorter versions of straps may be provided, with or without a central portion 184, to provide stability of alternative barricade configurations or to tie higher stacked sets of rail modules 68.

At this juncture it is to be noted that it is contemplated that the specific configurations of modules 68 and 90 can be altered by those skilled in the art without departing from the scope of the instant invention, for example: the specific polygonal configuration of the various projections and depressions can be varied so long as the complimentary relationship between cooperating portions is maintained; a flasher or signing depression such as depression 82 can be incorporated into sidewall 74 of rail module 68 intermediate locking depressions 86; and the like. The alternative module configurations may give rise to alternative system constructions.

It is further understood that with respect to the embodiments discussed hereinbefore and hereinafter suitable signing or diagonal reflective stripping can be readily applied in a variety of configurations and manners, for example through the use of glued-on sheeting or readily removable overlay signing printed on a clear transparent polyester.

Figure 12:
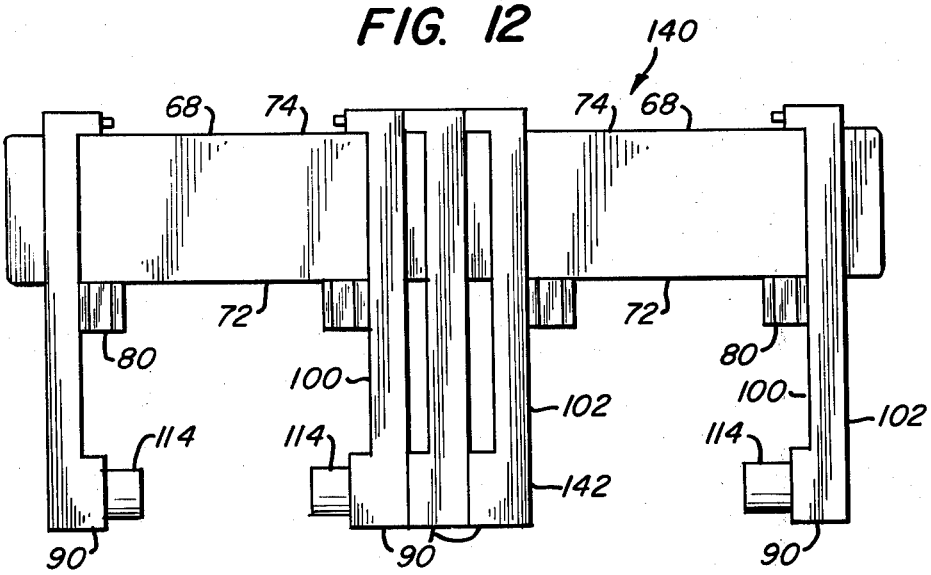
FIG. 12 is a longitudinal elevational view of still another embodiment of a Type I Barricade constructed in accordance with the principles of the present invention.

FIG. 12 is a longitudinal elevational view of a Type I Barricade 140 constructed in accordance with the principles of the present invention which comprises: vertically disposed end support modules 90; a central support portion 142 which as shown comprises three vertically disposed support modules 90 interlocked together in traversely stacked relationship and a pair of rail modules 68 each of which extend between an end module 90 and the central support portion 142. In a manner as described hereinbefore with respect to barricade 128 end portions of rail modules 68 are slidingly received through the walled openings 94. The interlocked stack of three support modules 90 which comprise the central support portion 142 provide a sufficient transverse dimension across support portion 142 to permit abutting of locking portions 80 with adjacent surfaces at the outer support modules 90 of central support portion 90. It is to be noted that the Type I Barricade 140 illustrated in FIG. 12 includes only two rail modules 68; however, if it were desired to construct a longer Type I Barricade such as Barricade 140 this could be readily accomplished through the use of more support portions 142 with respective rail modules 68 extending therebetween.

Figure 13:
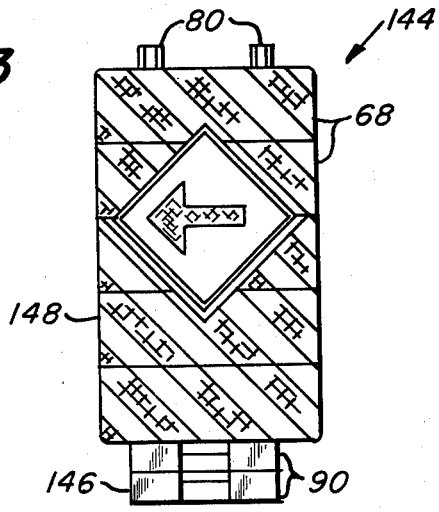
FIG. 13 is a longitudinal elevational view of a Type III Barricade constructed in accordance with the principles of the present invention.
Figure 14:
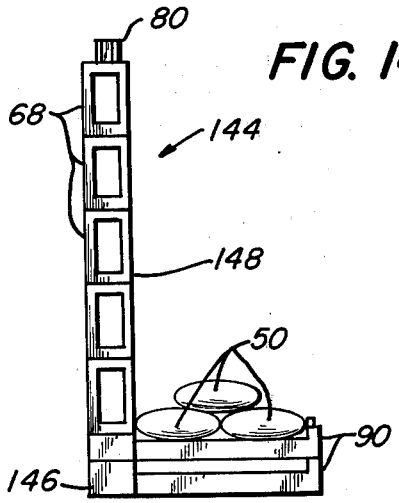
FIG. 14 is a side elevational view of the Type III Barricade illustrated in FIG. 13.

FIGS. 13 and 14 are elevational views of a Type III Barricade 144 constructed in accordance with the principles of the present invention which comprises: a base portion 146 and a barricade portion 148 and extending upwardly therefrom. As shown base portion 146 comprises a pair of transversely disposed stacked interlocked support modules 90 with inner wall 100 facing upwardly. Barricade portion 148 comprises a plurality of five transversely disposed stacked interlocked rail modules 68 which have the respective sidewalls 72 facing upwardly. Barricade 148 is captively received and carried by base portion 146 by locking projections 104 of support module 90 being slidably and captively received within the locking depressions 86 of the lowermost rail module 68 of barricade. portion 148.

With an arrangement of barricade 144 as described hereinabove the outward extension of support modules 90 presents an excellent resistance to overturning moment with respect to forces directed to barricade 144 in the direction of the outward extension of modules 90. To aid the barricade 144 to resist overturning moment in a direction opposite to that described hereinabove, additional ballast may be added to barricade 144 such as filling modules 68 and 90 with a hydraulic fluid and/or placing one or a plurality of sand bags 150 on inner wall 100 of the upper support module 90 of base portion 146.

It will become apparent to those skilled in the art that various modifications can readily be made to barricade 144, for example: more or less modules 68 and 90 may be added or deleted which, together with including stripping only on alternative rail modules 68 will result in the construction of an acceptable Type II Barricade; a transversely extended base of adjacent modules 90 can be included which are interlocked with a rail module 68 extending between adjacent modules 90; a flasher 132 can be inserted into depression 82 of the uppermost module 68 of barricade portion 148.

Figure 15:
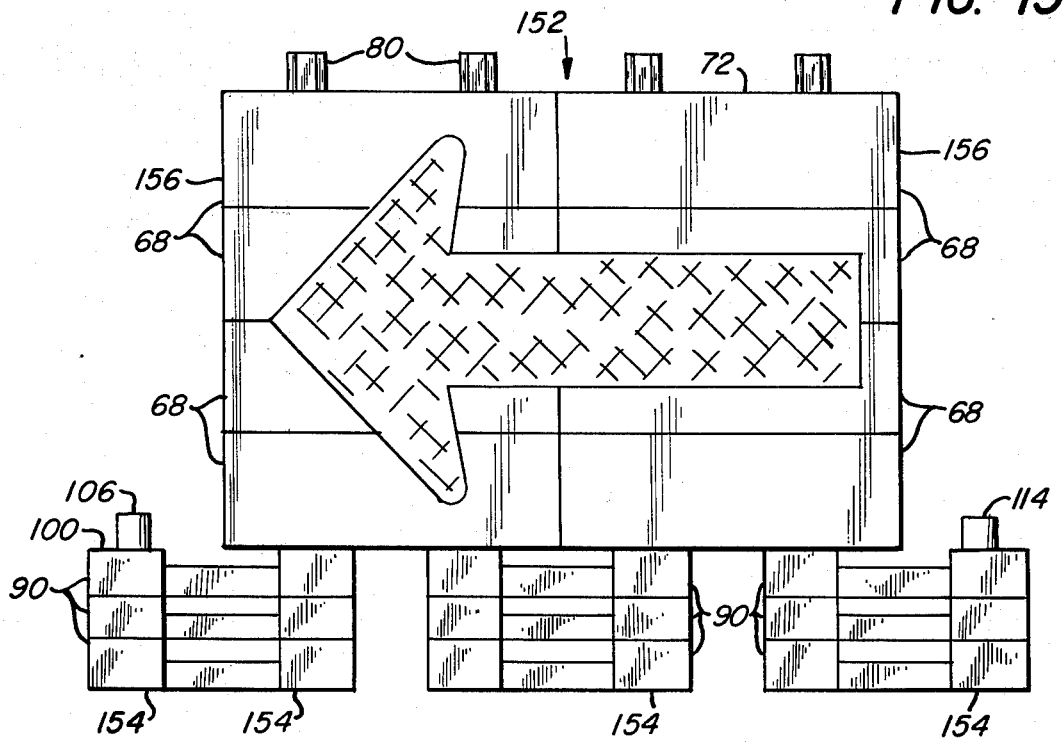
FIG. 15 is a longitudinal elevational view of another embodiment of a Type III Barricade constructed in accordance with the principles of the present invention.

FIG. 15 is a longitudinal elevational view of an alternative embodiment of a Type III Barricade 152 constructed in accordance with the principles of the present invention which is similar to the embodiment described hereinabove and comprises three transversely spaced base portions 154 and barricade portions 156 captively carried by base portion 154 and extending upwardly therefrom. As shown base portions 154 each comprise three transversely disposed stacked interlocking support modules 90 with innerwall 100 facing upwardly. Each barricade portion 156 comprises three transversely disposed stacked interlocked rail modules 68 with sidewall 72 facing upwardly. The transverse spacing between adjacent base portions 154 is such that the spacing between adjacent locking projections 106 corresponds to the spacing between locking depressions 86 of rail modules 68 thereby permitting adjacent base portions 154 to be interlocked by barricade portions 156 overlapping adjacent base portions 154 and adjacent locking projections 106 being slidably captively received within depressions 86. With such an arrangement the adjacent barricades 156 are in abutting relation at the inner ends thereof. The overlay signing on the illustrated barricade 156 show a large arrow which utilizes portions of six of the eight rail modules 68 of the barricade portions 156.

Figure 16:
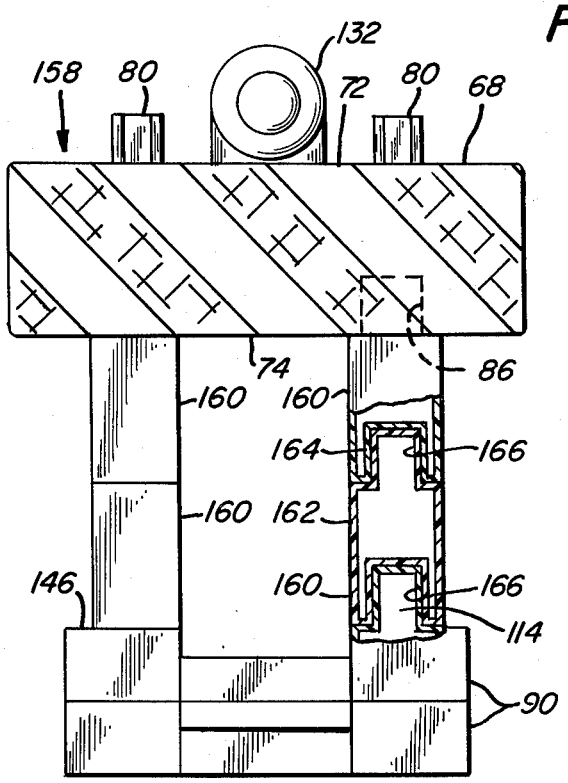
FIG. 16 is a longitudinal elevational view of yet another embodiment of the Type I Barricade constructed in accordance with the principles of this invention and which includes vertical post extensions.

FIG. 16 is a longitudinal elevational view of a barricade 158 which is constructed in accordance with the principles of the present invention and conceptially can be utilized as a Type I or Type II barricade. Barricade 158 comprises a base portion 146 and a transversely disposed rail module 68 vertically spaced from base portion 146 and captively retained with respect thereto by means of extension members 160 extending vertically therebetween. As shown extension members 160 comprises: an elongated hollow body member 162 having a generally square cross section; a polygonal locking projection 164 extending upwardly from an axial end of body member 162 and a polygonal locking depression 166 extending inwardly from the opposite axial end of body member 162. Projection 164 and depression 166 have a generally complimentary peripheral configuration and are also complimentary to projections 114 and depressions 86. With the utilization of extension members 160 a Type I or Type II Barricade having the height suggested by the applicable codes can be assembled while still taking advantage of the increased overturning moment resistance of the transversely disposed portion 146. As can be seen barricade 158 is constructed by assembling two pairs of extension members 160 with the locking projection of the lower extension member 160 being slidably and captively received within the locking projection of the upper extension member 160.The assembled pairs of members 160 are thus received between base portion 146 and rail 68 cooperate with respective locking projections and depressions for the final assembly of barricades 158. It is to be noted that through the use of extension members 160 a variety of alterations can be made to the embodiments discussed hereinbefore as conditions may dictate, for example; alternate rail modules of Type III barricades can be replaced by vertically disposed extension members 160 thereby offering a less expensive barricade construction without forfeiting stability and also offering a barricade which is more resistant to wind by decreasing surface area.

Figure 17:
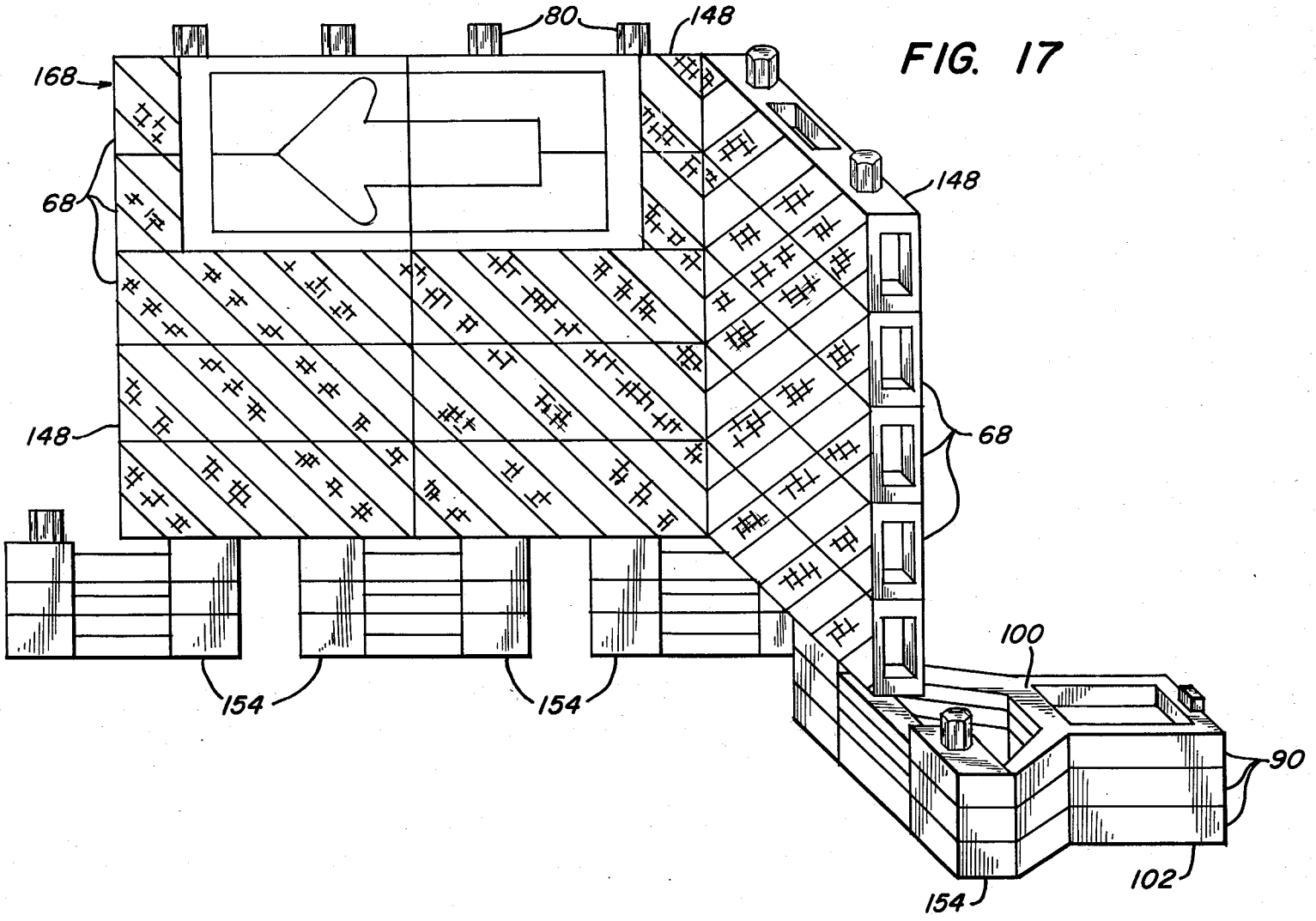
FIG. 17 is a longitudinal view, partially prospective of a Wing Barricade constructed in accordance with the principles of the present invention.

FIG. 17 is a longitudinal elevational view, partially perspective of a wing barricade 168 constructed in accordance with the principles of the present invention. Barricade 168 comprises: three aligned transversely disposed spaced base portions 154; a forth transversely disposed base portion 154 diagonally spaced from an adjacent base portion 154; and three barricade portions 148. As illustrated two of the barricade portions 148 are arranged in parallel abutting relationship and interlock the three aligned base portions 154 and the third barricade portion 148 interlocks the diagonally spaced end base portion 154 and the base portion 154 adjacent thereto and abuts and end wall of an adjacent barricade portion 148 on the inner side thereof. It is to be noted that wing barricade 168 is signed with both diagonal markings and a directional arrow.

Figure 18:
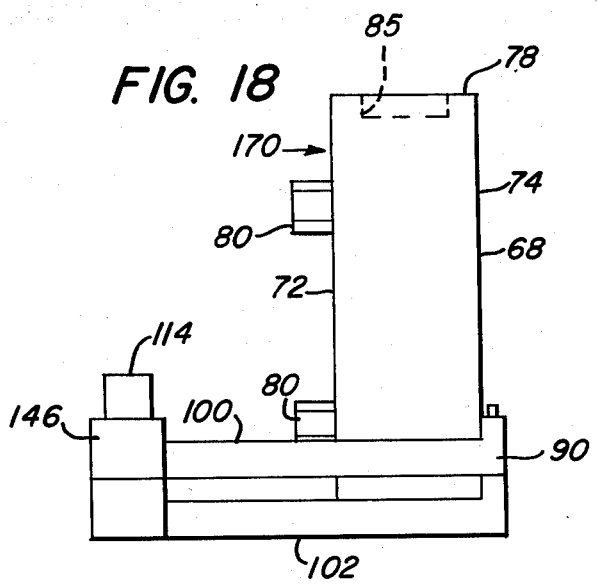
FIG. 18 is a side elevational view of a single pillar with a double base (Vertical Panel), constructed in accordance with the principles of the present invention.

FIG. 18 is a longitudinal side elevational view of a utility barrier 170 constructed in accordance with the principles of the present invention. Barrier 170 comprises a transversely disposed base portion 146 and a single vertically extending rail module 68 captively carried thereby. As shown, the lower end portion of rail module 68 is received within the aligned walled openings 94 and the lowermost locking projection 80 abuts the rail locking groove 120. If desired a flasher 132 (not shown) can be inserted within the upper flasher depression 85. Utility barrier 170 is constructed to have a comparatively narrow transverse profile and as such is aptly suited for use as a channelizing device therefore being an excellent replacement for existing channelizing devices such as vertical panels 60 and drum type barricades 66.

Figure 19:
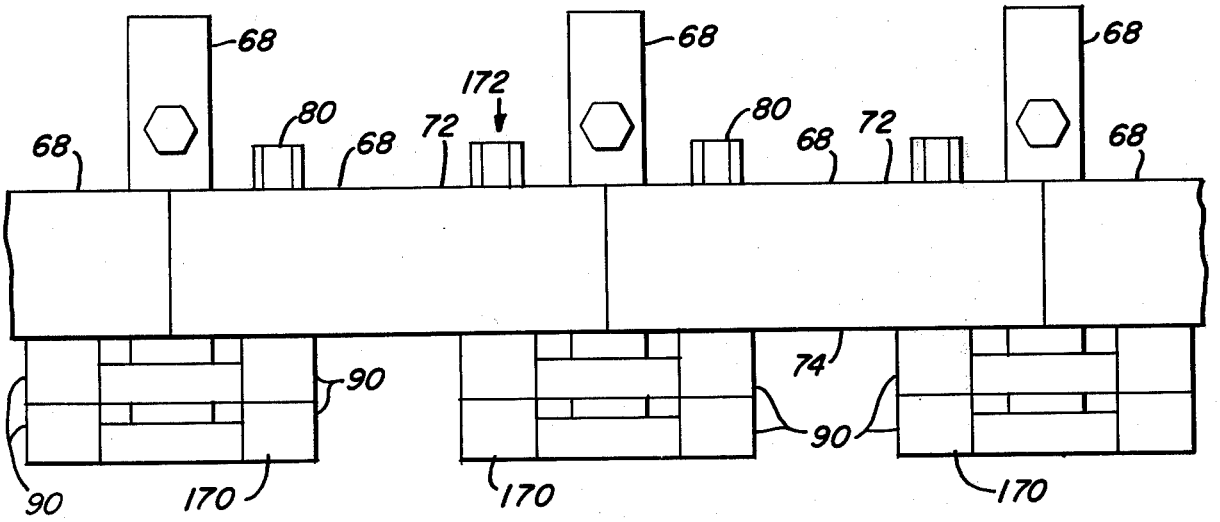
FIG. 19 is a longitudinal elevational view of a guide or channeling Rail and Post assembly constructed in accordance with the principles of the present invention.

FIG. 19 is partial longitudinal elevational view of a guard rail and post assembly 172 which comprises a transversely spaced plurality of utility barriers 170 interlocked together in a continuous manner by means of rail modules 68 extending between adjacent utility barriers 170. The guard and post assembly 172 may be used to extend continuously between adjacent traffic lanes if desired.

In addition to the several embodiments of the invention discussed hereinabove it is to be understood that various modifications can be made thereto and other alternative barrier systems can be created without departing from the invention hereof, for example: mated module units may be strapped together for additional stability; extension members 160 can be positioned to extend between vertically disposed and transversely spaced support modules 90 to increase stability; various peripheral alterations can be made to 68 and 90 so long as the proper mating relationships are maintained; saddle arrangements can be adapted for use with the modules to increase usage of existing signing; various auxiliaries may be utilized with the modules either through snap on captive retention or threaded reception if desired; and the like.

What is claimed is:

1. A portable barrier system for use on roadways or the like comprising: a plurality of hollow elongated support modules formed of a resinlike material; at least one hollow elongated rail module formed of a resinlike material; first retaining means on one side of said support modules which are selectively cooperable with second retaining means on the other side of said support modules to releasably and captively retain adjacent support modules when said support modules are stacked one upon the other; said support modules including third retaining means adjacent one end portion thereof axially spaced from said first and second retaining means and selectively cooperable with a respective axial end portion of said rail module to releasably and captively retain said one end portion of said rail module; and said rail module including fourth retaining means on one side thereof which are selectively cooperable with said first retaining means to releasably and captively retain said rail module with respect to said support module.

2. A portable barrier system as specified in claim 1 wherein said retaining means are integrally formed with said respective modules.

3. A portable barrier system as specified in claim 2 wherein said first and second retaining means are substantially coaxial and said first retaining means extend outwardly from said one side of said support modules and said second retaining means extend inwardly from the other side of said support modules.

4. A portable barrier system as specified in claim 3 wherein said first, second and fourth retaining means include complimentary polygonal configurations.

5. A portable barrier system as specified in claim 1 additionally including fifth retaining means on said side of said support modules which are selectively cooperable with sixth retaining means on the other side of said support modules to releasably and captively retain adjacent support modules when said support modules are stacked one upon the other and said fifth and sixth retaining means are adjacent said one portion of said support modules.

6. A portable barrier system as specified in claim 1 wherein said third retaining means includes an opening through said support modules and the internal periphery of said opening is complimentary with respect to the external periphery of said axial end portion of said rail module.

7. A portable barrier system as specified in claim 1 wherein said support modules have a generally "A" shaped configuration and said rail modules have a generally rectangular configuration.

8. A portable barrier system as specified in claim 1 wherein said rail modules include seventh retaining means on an opposite side thereof and which are selectively cooperable and coaxial with said fourth retaining means to releasably and captively retain adjacent rail modules when said rail modules are stacked one upon the other.

9. A portable barrier system as specified in claim 1 wherein said modules include fill and drain means adjacent each respective axial end thereof.

10. A portable barrier system as specified in claim 9 wherein at least one of said drain means on each of said modules is responsive to the pressure within the respective module.

11. A portable barrier system as specified in claim 8 wherein a plurality of different type barricades are selectively formed from said modules only.

12. A portable barrier system as specified in claim 8 wherein Type I, Type II, Type III and Vertical Panel Type barricades are selectively formed from said modules only.

13. A portable barrier system as specified in claim 11 wherein in some of said barricade applications said rail modules are vertically disposed and in other of said barricade applications said rail modules are horizontally disposed.

14. A portable barrier system as specified in claim 1 wherein said rail module includes at least one depression formed therewithin for selectively and captively receiving an auxiliary element therewithin.

15. A portable barrier system as specified in claim 1 additionally including elongated extension and stabilizing modules selectively and captively received intermediate said first and second retaining means of spaced pairs of said support modules

16. A portable barrier system as specified in claim 15 wherein each of said portable barriers include retaining means corresponding to said first and second retaining means adjacent the respective axial ends thereof.

* * * * *